US007748555B2

(12) United States Patent
Owens et al.

(10) Patent No.: US 7,748,555 B2
(45) **Date of Patent: *Jul. 6, 2010**

(54) SPRING-LOADED SECONDARY SEAL FOR FLOATING-ROOF STORAGE TANK

(75) Inventors: John E. Owens, Cypress, TX (US); Terry A. Gallagher, Wheaton, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 1121 days.

This patent is subject to a terminal disclaimer.

(21) Appl. No.: 10/889,404

(22) Filed: Jul. 12, 2004

(65) Prior Publication Data

US 2005/0072782 A1 Apr. 7, 2005

Related U.S. Application Data

(63) Continuation-in-part of application No. 10/320,093, filed on Dec. 16, 2002, now Pat. No. 7,044,322.

(51) Int. Cl.
*B65D 88/46* (2006.01)

(52) U.S. Cl. ..... 220/224; 220/216

(58) Field of Classification Search ..... 220/216, 220/221, 222, 224

See application file for complete search history.

(56) References Cited

U.S. PATENT DOCUMENTS

| | | | | |
|---|---|---|---|---|
| 2,427,171 | A | 9/1947 | Wiggins | |
| 2,536,019 | A | 1/1951 | Allen | |
| 2,855,122 | A * | 10/1958 | Ulm et al. | 220/219 |
| 2,897,998 | A | 8/1959 | Ulm | |
| 2,960,252 | A * | 11/1960 | Ulm | 220/224 |
| 3,595,432 | A * | 7/1971 | Van der Heijden et al. | 220/224 |
| 4,116,358 | A | 9/1978 | Kinghorn et al. | |
| 4,126,243 | A | 11/1978 | Bruening | |
| 4,138,032 | A | 2/1979 | McCabe | |
| 4,287,999 | A | 9/1981 | Heisterberg | |
| 4,308,968 | A | 1/1982 | Thiltgen et al. | |
| 4,339,052 | A | 7/1982 | Hills et al. | |
| 4,353,477 | A | 10/1982 | Bruening | |
| 4,493,430 | A | 1/1985 | Sie | |
| 4,524,878 | A * | 6/1985 | Imhof | 220/224 |

(Continued)

FOREIGN PATENT DOCUMENTS

| | | |
|---|---|---|
| EP | 0 781 715 A1 | 12/1996 |

(Continued)

OTHER PUBLICATIONS

International Search Report on International (PCT) Application No. PCT/US 03/39790 dated Jun. 3, 2004.

(Continued)

*Primary Examiner*—Anthony Stashick
*Assistant Examiner*—James N Smalley
(74) *Attorney, Agent, or Firm*—Osha • Liang LLP

(57) ABSTRACT

A low-profile secondary seal for floating-roof storage tanks has a tip seal that is mounted on a series of segmental adapter plates connected to the shoe plates. A fabric extends between the tip seal and the floating roof. A spring presses the tip seal against the tank shell.

11 Claims, 6 Drawing Sheets

U.S. PATENT DOCUMENTS

| | | | | | |
|---|---|---|---|---|---|
| 4,540,104 | A | * | 9/1985 | Kawai et al. | 220/224 |
| 4,615,458 | A | | 10/1986 | Grove et al. | |
| 5,036,995 | A | | 8/1991 | Wagoner | |
| 5,284,269 | A | | 2/1994 | Petrie et al. | |
| 5,351,848 | A | | 10/1994 | Wagoner | |
| 5,515,989 | A | * | 5/1996 | Petrie et al. | 220/224 |
| 5,529,200 | A | * | 6/1996 | Ford et al. | 220/218 |
| 5,667,091 | A | | 9/1997 | Slaber, Jr. et al. | |
| 5,927,534 | A | * | 7/1999 | King et al. | 220/224 |
| 6,164,479 | A | * | 12/2000 | Kern | 220/216 |
| 6,247,607 | B1 | * | 6/2001 | King | 220/221 |
| 6,354,488 | B1 | * | 3/2002 | Gallagher | 220/221 |
| 2004/0112897 | A1 | | 6/2004 | Owens et al. | |

FOREIGN PATENT DOCUMENTS

| | | |
|---|---|---|
| EP | 1 234 784 A1 | 2/2001 |

OTHER PUBLICATIONS

Oct. 28, 2005 international search report on corresponding international application PCT/US2005/024490.
Examination Report for related New Zealand patent application No. 552586; dated May 21, 2009 (2 pages).
Substantive Examination Report for related Malaysian patent application No. P1 20053169; dated Feb. 25, 2010 (3 pages).

* cited by examiner

Figure 1 - Prior Art

SPRING-LOADED SECONDARY SEAL FOR FLOATING-ROOF STORAGE TANK

RELATED APPLICATIONS

This is a continuation-in-part of application Ser. No. 10/320,093, filed on Dec. 16, 2002 now U.S. Pat. No. 7,044,322.

BACKGROUND OF THE INVENTION

This invention relates generally to storage tanks having roofs that float on the surface of the stored product, and more particularly to secondary seals used in such tanks.

Floating roof tanks are widely used to store volatile petroleum-based liquids and limit the quantity of product evaporative emissions that may escape to the environment. Such tanks may be configured either as internal floating-roof tanks or as external floating-roof tanks. In each configuration, the floating roof is designed to remain in contact with the liquid surface of the product and to cover all of the surface of the product except for a small annular surface area between the outermost rim of the floating roof and the inside surface of the tank shell. A single primary rim seal may control product evaporative emissions from this annular area. However, for increased effectiveness, emissions from this annular area are conventionally controlled by a combination of perimeter rim seals, including a primary seal with a secondary seal mounted in the rim space above it.

Primary seals conventionally take the form of a piece of fabric extending between the floating roof and a shoe plate that bears on the tank shell. Examples of such seals are illustrated in Wagoner, U.S. Pat. No. 5,036,995 and in Ford et al, U.S. Pat. No. 5,529,200. Alternatively, primary seals may be in the form of resilient liquid- or foam-filled seals that are supported from the floating roof.

Allen et al., U.S. Pat. No, 2,536,019, discloses a seal that is spring-loaded and supported from the top of the floating roof pontoon. In addition to problems arising from stress on the seal structure when the illustrated shoe plates move vertically as the roof moves laterally, there are basic problems with this design due to interaction between the primary shoe and the closely-mounted tip seal.

By current EPA definition, secondary seals for floating-roof tanks span the entire distance between the floating roof and the tank shell, above a primary seal. Most conventional secondary seals are mounted to the floating roof and extend upwards across the annular rim space to contact the tank shell some vertical distance above the floating roof. The vertical distance represents a characteristic clearance requirement for the secondary seal.

One prevalent type of secondary seal includes metal compression plates that attach to the floating roof and support a tip seal against the tank shell, as disclosed in Kinghom et al., U.S. Pat. No. 4,116,358; Grove et al., U.S. Pat. No. 4,615,458; and Thiltgen et al., U.S. Pat. No. 4,308,968. In each of these designs, the compression plates are mounted at an angle to the tank shell.

The angle of the compression plates is critical. If the angle is too steep, the tip seal can become jammed against the tank shell as the seal attempts to pass over weld seams or other surface irregularities on the tank shell. If the angle is too shallow, the tip seal can drag against the tank shell or catch on a weld seam or other shell discontinuity. Either event may cause the compression plates to fold into the rim space and damage one or more sections of the secondary seal, opening gaps between the tip seal and the tank shell that can lead to increased evaporative emissions to the atmosphere.

Further, as a floating roof drifts toward one section of the tank shell, the angle of the compression plates becomes more vertical, increasing the vertical clearance required to keep the tip seal inside the tank and in contact with the tank shell. For a typical storage tank with a nominal 8" rim space, the width of the rim space at any particular point may actually vary between about 4" to more than 12" as the roof moves, increasing the vertical clearance requirement to as much as 24". Tank size or tank foundation considerations may also dictate a 10-inch or even 12-inch nominal width for the rim space, with permissible variations as large as ±7 inches or more. Consequently, the vertical clearance requirement for conventional secondary seals may sometimes exceed 31".

This vertical clearance requirement presents a problem both for new tanks and for retrofitting old tanks. New tanks must be designed with excess, unusable capacity to account for the required vertical clearance, adding to the construction cost. Similarly, when a secondary seal is added to an existing floating-roof tank, the maximum filling height of the tank may need to be reduced to accommodate the required vertical clearance for the secondary seal. Any such reduction of the maximum filling height represents lost inventory to the owner/operator of the tank. For example, when a secondary seal is added to an existing 100-foot (≈30 meter) diameter floating-roof tank, a nominal 2-foot (0.6 meter) reduction in filling height represents a loss of approximately 117,500 gallons (2800 Bbl) of product storage. Such a loss can significantly reduce the revenue of the owner/operator of the tank.

Hills et al., U.S. Pat. No. 4,339,052, discloses a secondary seal in the form of a tube that is connected near the top of the floating roof. One problem with this arrangement is that the secondary seal can rotate upwards, out of the rim space as the floating roof descends during product send-out operations. Petri et al., U.S. Pat. No. 5,284,269, discloses a space-saving double-seal system comprised of two shoe segments mounted above each other. One problem with this arrangement is that the shoe supports of the primary seal extend beneath the floating roof, increasing the risk of interference with equipment inside the tank.

The tip seal in the Allen patent is mounted directly to the top of the shoe plate. Although this arrangement would require a minimum vertical clearance, the tip seal does not extend all the way to the floating roof and thus does not, under EPA guidelines, constitute a true secondary seal. Further, connecting the tip seal directly to the top of the shoe plate creates a risk that movement over girth seams, etc. that may cause the shoe plate to separate from the tank shell might also cause the tip seal to separate from the tank shell.

None of these seal configurations have found significant commercial success.

Because of disadvantages in previously-disclosed low-profile secondary seals, it is believed that there is a need for a new low-profile secondary seal that can be used to increase the storage capacity of existing floating-roof tanks currently equipped with conventional primary seals. Gallagher, U.S. Pat. No. 6,354,488 presents a low-profile secondary seal that can be used with a conventional primary seal utilizing shoe plates and a fabric seal. The tip seal is held against the tank shell by a resilient tube seal. While this low-profile secondary seal reduces the clearance required, there are alternative methods that will maintain tip pressure, possibly over a wider operating range with a lower clearance requirement.

SUMMARY OF THE INVENTION

The present invention describes such a low-profile secondary seal. It may be used with a conventional primary seal utilizing shoe plates and a fabric primary seal. The secondary seal includes a tip seal positioned above the primary shoe plate by multiple, segmental tip adapter plates. Tip seal contact against the tank shell is maintained by a series of horizontally-mounted springs that extend from the floating roof to the tip adapter plates. In use, the springs bear on the tip adapter plates with sufficient force to maintain the secondary tip seal in close sealing engagement against the tank shell whether the roof is at a minimum or maximum rim space condition.

In some embodiments of the invention, the tip seal may be no more than about twelve inches above the top of the floating roof. It may include a tip adapter in the form of a series of inwardly-projecting plates on which the springs act. A rim plate adapter may be included to secure the springs to the floating roof and keep the secondary fabric seal from becoming caught in the springs. A fabric protector can be used to prevent water or debris from accumulating on the secondary fabric seal between the tip seal and the floating roof. Electrical shunts may be extended from the tip seal to the floating roof, and from the tip seal to the shell.

DETAILED DESCRIPTION OF THE DRAWINGS

Figure 1:
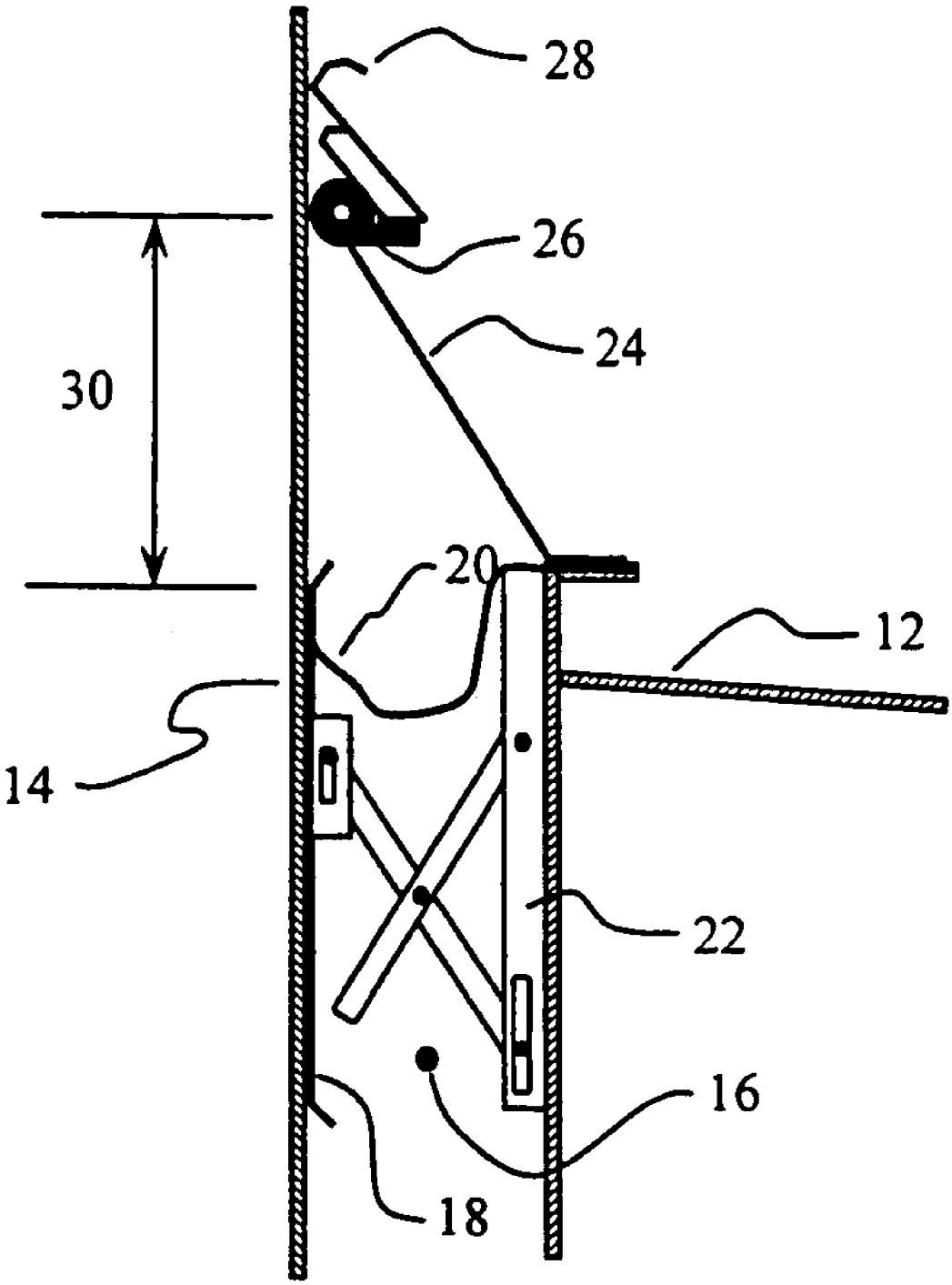
FIG. 1 is a cross-sectional view of a prior art secondary seal.

FIG. 1 illustrates a typical prior art secondary seal in an external, floating-roof tank. A floating roof 12 floats within a tank shell 14, leaving a rim space 16 between the roof and the shell. A fixed roof, spanning the entire tank or supported by columns, can also be added to create an internal floating-roof tank.

Multiple overlapping primary shoe plates 18 form a continuous primary seal against the inside surface of the tank shell 14. Each shoe plate is partially submerged in the stored product and extends above the liquid surface of the product to an elevation near the top of the floating roof 12. The rim space 16 is substantially closed by a primary seal 20 that is connected directly to the upper portion of each shoe plate 18 and extends to the floating roof 12. The individual shoe plates are held against the inside surface of the tank shell by a series of spring-loaded hangers 22. Typically, three hangers are used for each shoe plate. Each hanger generates sufficient force to ensure that a minimum gap is maintained between the shoe plates and the tank shell over the full operating rim space range. Minimizing the gap is desirable for good evaporative emission control.

In the illustrated prior art design, multiple metal compression plates 24 are attached to the outer rim of the floating roof 12 above the primary seal 20 to form part of a secondary seal. The compression plates are arranged in overlapping sequence to provide continuous coverage of the rim space 16. Sections of the tip seal 26 are secured to the upper flange of the compression plates, and bear against the tank shell. Individual electrical shunts 28 are installed as extensions of the compression plates 24, and are disposed at equal spacing around the floating-roof perimeter. The vertical clearance requirement 30 between the tip seal 26 and the top of the floating roof 12 represents lost storage capacity in the tank.

Figure 2:
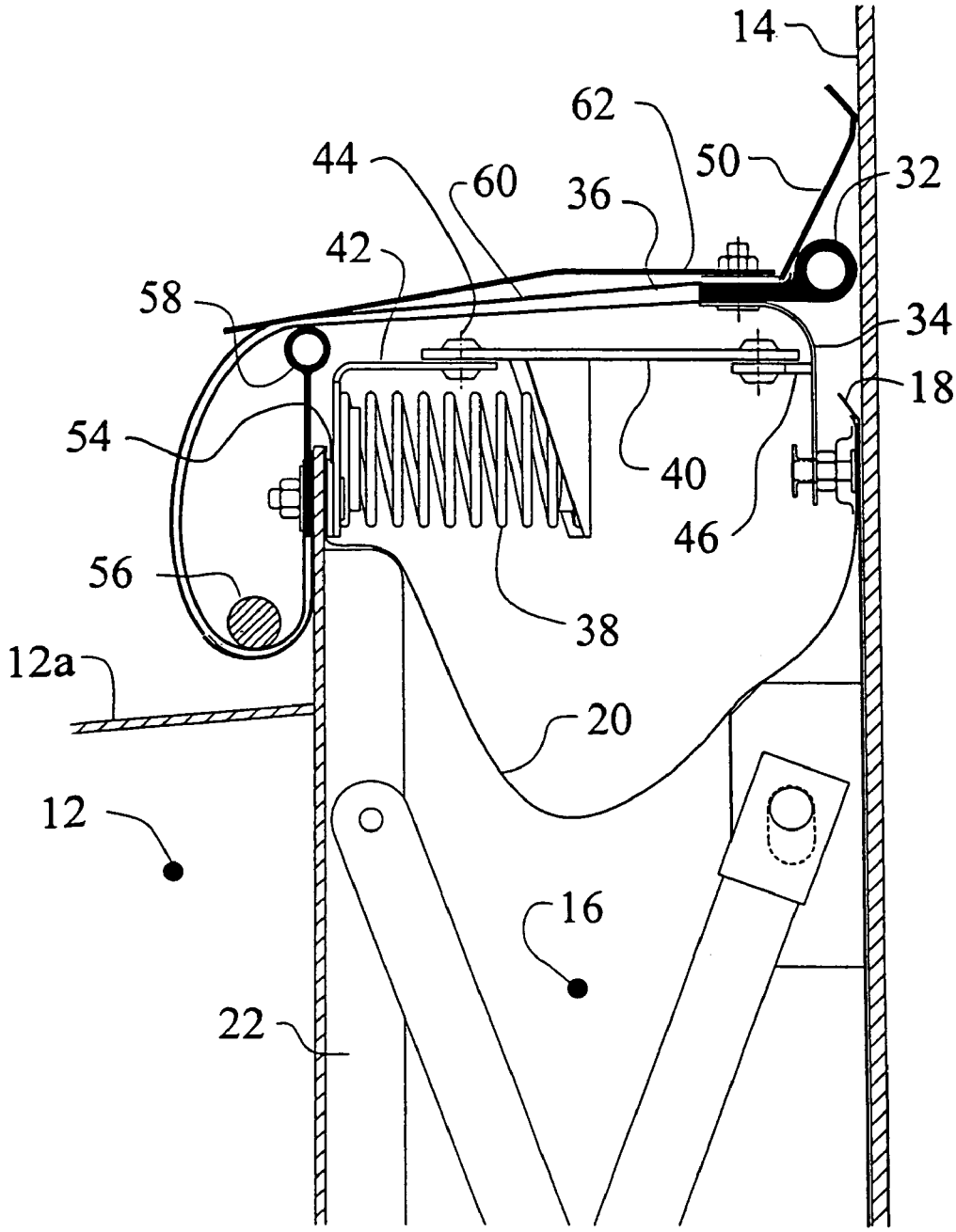
FIG. 2 is a cross-sectional view of one embodiment of a secondary seal in accordance with the present invention.
Figure 3:
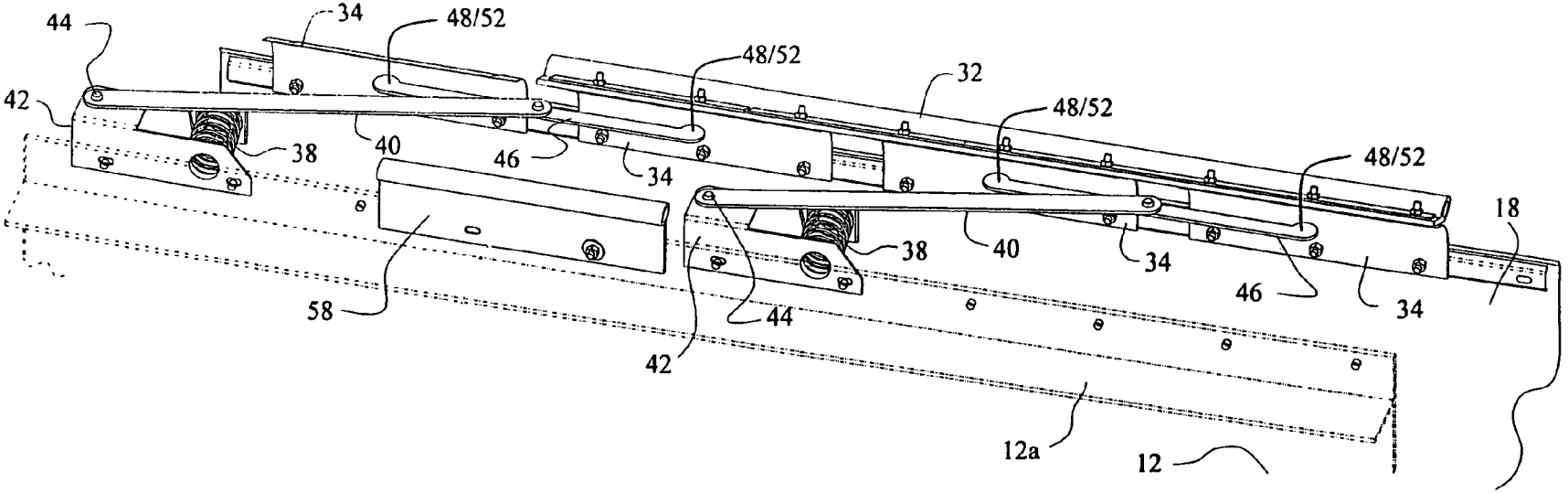
FIG. 3 is a perspective view of the secondary seal seen in FIG. 2, with the fabric removed for clarity.

FIGS. 2 and 3 illustrate a storage tank in which a new, low-profile, spring-loaded secondary seal is installed. The tank includes a primary seal 20 that seals the rim space 16 between the floating roof 12 and the tank shell 14. The primary seal 20 can be of any conventional mechanical shoe seal design, but should keep the rim space substantially closed over the full rim space range. As illustrated, the primary seal includes conventional shoe plates 18 and spring-loaded hangers 22. The illustrated hangers maintain the shoe plates at the same elevation with respect to the floating roof as the roof moves laterally. In the embodiment of the invention seen in FIGS. 2 and 3, a secondary tip seal assembly includes a conventional tip seal 32 and multiple adapter plates 34.

The position of the tip seal 32 is new. The tip seal is no more than about twelve inches above the top deck 12*a* of the floating roof 12. The adapter plates 34 are supported from the upper section of the shoe plates and are set in a sequential configuration, as seen in FIG. 3. Each adapter plate 34 extends upwardly from a shoe plate 18 and includes a mounting flange on which the tip seal 32 is disposed.

The secondary seal also includes a fabric barrier 36 that covers the rim space 16 between the floating roof 12 and the tip seal 32. In the illustrated embodiment of the invention, the fabric barrier 36 is attached at one end to the floating roof 12 with the other end connected below the tip seal 32 on the mounting flange on the adapter plates 34.

Figure 4:
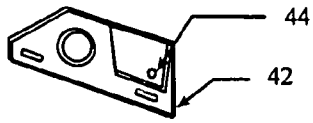
FIG. 4 is a perspective view of a mounting bracket that can be installed on a floating roof to serve as a base for a spring and pusher.

The secondary seal also includes a spring 38 and, in FIGS. 2-7, a pusher 40. The spring 38 biases the pusher outwardly from the floating roof 12. In the illustrated design, both the spring and the pusher are attached to a mounting bracket 42 on the floating roof. One possible mounting bracket is illustrated in FIG. 4. In that configuration, the inner end of the pusher 40 is connected to the mounting bracket at a hinge 44, and extends from the floating roof at a radially-oblique angle (i.e., the axis of the pusher does not intersect the centerline of the floating roof). Rather than being co-axial with the pusher 40, the illustrated spring 38 is connected to the pusher 40 at an inclined angle. In this configuration, the pusher, spring, and hinge form a lever, providing a mechanical advantage.

Figure 5:
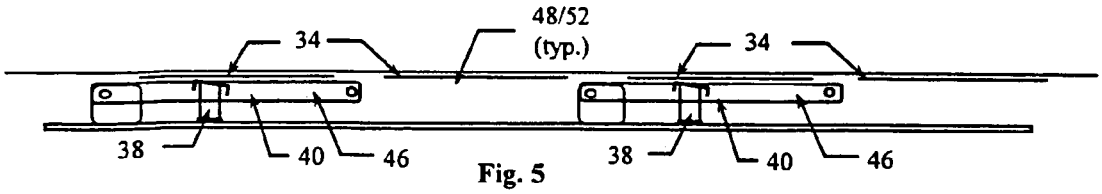
FIGS. 5-7 are top views showing movement of the secondary seal of FIG. 2 as the floating roof moves with respect to the tank shell.
Figure 6:
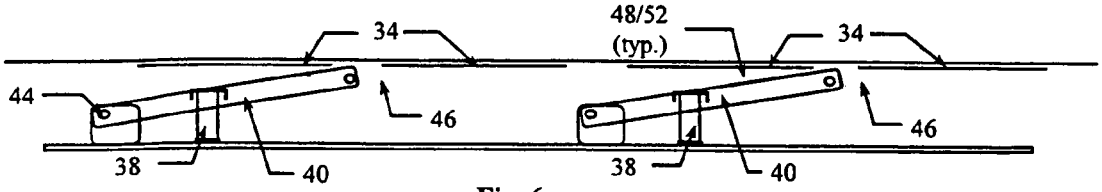
Figure 7:
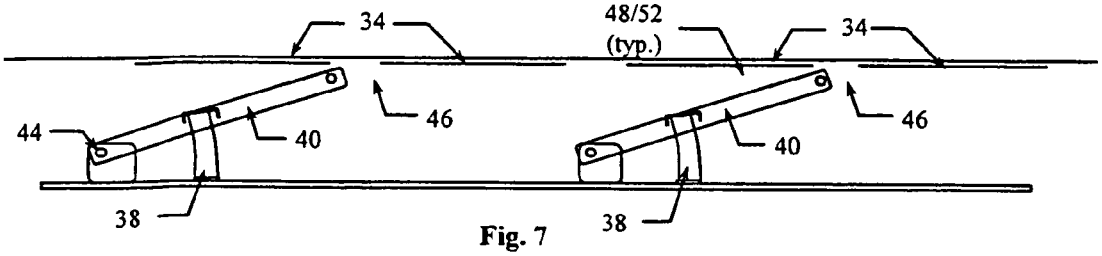

The illustrated pusher 40 includes a pusher bar 46 at its outer end. The tip seal 32 is seated against the tank shell 14 by the force of the spring 38, which is leveraged by the pusher 40 and transmitted to the adapter plates 34 through two opposed ends 48 of the pusher bar 46. The pusher bar 46 is not affixed to the adapter plates 34, but instead presses against them to permit sliding along the adapter plates 34 as the rim space 16 changes in width with the shifting of the floating roof 12, as seen in FIGS. 5-7. The force of the spring 38 pressing the pusher 40 on the adapter plates 34 may also reduce the gap between the tank shell 14 and the shoe plates 18, further helping to reduce emissions.

Figure 8:
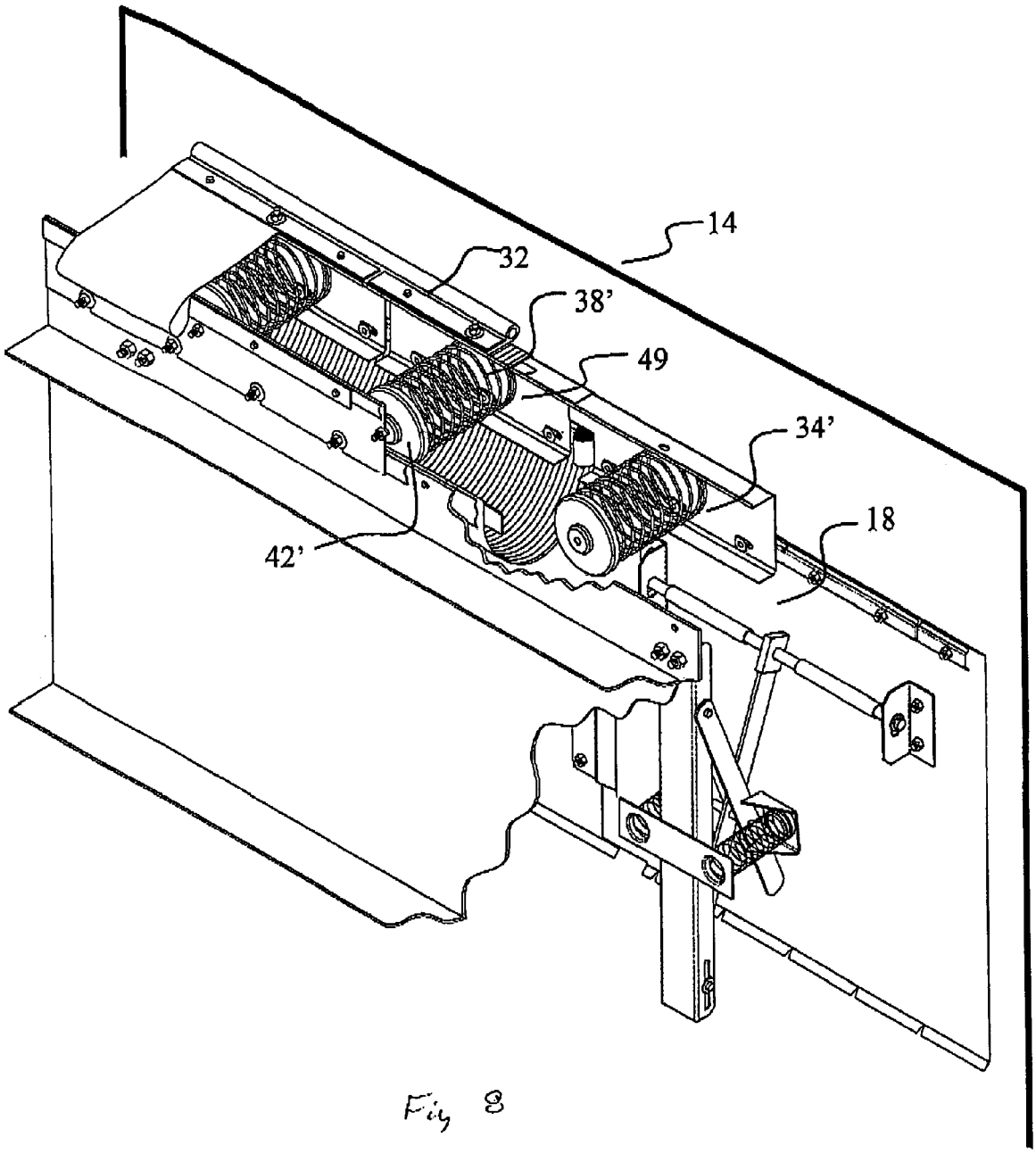
FIG. 8 is a perspective view of an alternative embodiment of a secondary seal in accordance with the present invention.
Figure 9:
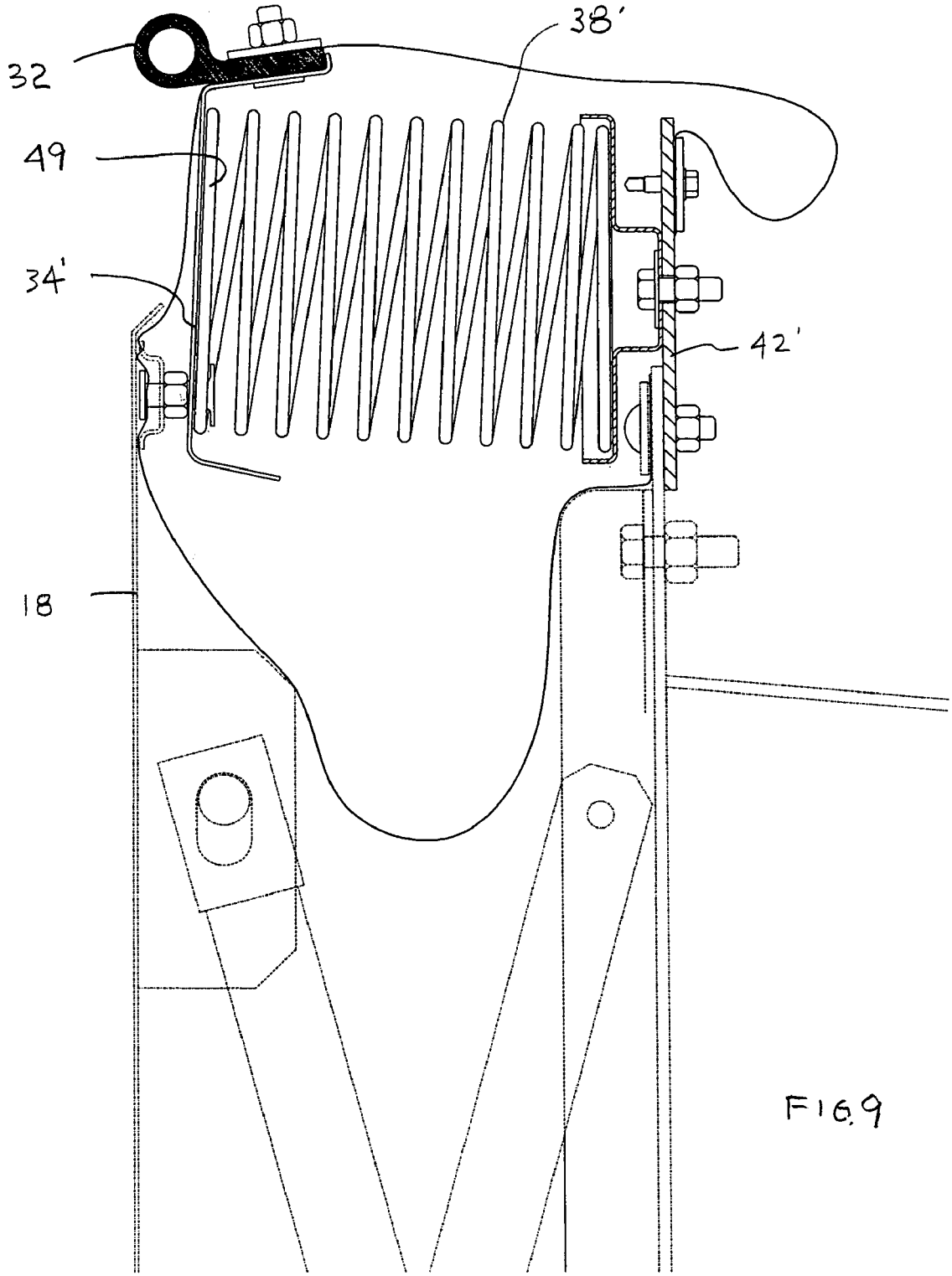
FIG. 9 is a cross-sectional view of the embodiment seen in FIG. 8.

FIGS. 8 and 9 show a comparable arrangement, in which no pusher bars 46 are used. As in the embodiment of the invention seen in FIGS. 2 and 3, springs 38' are attached to a mounting bracket 42' on the floating roof. Instead of pressing against a pusher, however, the spring presses directly against the adapter plates 34' that extend upwardly from the shoe plates 18. The tip seal 32 is seated against the tank shell 14 by the direct force of the springs 38'. As discussed above, the force of the springs 38' on the adapter plates 34' may also reduce the gap between the tank shell and the shoe plates 18, further helping to reduce emissions. In this illustrated embodiment of the invention, the physical spacing between the tip seal 32 and the top of the shoe plate 18 is about 6", and the base 49 of the springs are positioned on the adapter plates 34' between the tip seal and the top of the shoe plates. This spacing and positioning help to ensure that horizontally-disposed obstructions that may cause separation of either the primary seal or the secondary seal from the tank shell 14 do not also result in separation of the other seal.

A conventional electrical shunt 50 with an extension 60 may be attached to the floating roof 12 to provide electrical continuity between the tank shell 14 and the floating roof. Insulated washers 54 at each mounting bracket bolt and insulating skid pads 52 at each end of the pusher bar 40 may be added to control electrical continuity between the floating roof 12 and the tank shell 14. The use of electrical insulators and shunts can reduce the effects of lightning strikes on the floating roof 12.

There are several structural details that can improve implementation of the invention, but are not a necessary part of the invention. For example, as seen in FIG. 2, a weight 56 in the fabric 36 can be used to weigh down the fabric and keep it taut above the rim space 16. In addition, a washer bar/fabric protector 58 can be connected to the floating roof 12 beneath the fabric 36. Such a protector can prevent the fabric from rubbing against the pusher 40 or other components of the tank, extending the life of the fabric 36. A separate weather barrier 62 may be added above fabric barrier 36 to prevent water or debris from accumulating between the tip seal 32 and the floating roof 12, and providing a smooth, sloped surface from the tip seal 32 to the floating roof 12.

This detailed description has been given for clarity of understanding only. It is not intended and should not be construed as limiting the scope of the invention, which is defined in the following claims.

We claim:

1. A secondary seal for a liquid storage tank that has a tank shell, a floating roof, and a primary seal that is connected to the floating roof and has shoe plates adjacent the tank shell, the secondary seal comprising:

adapter plates that mount to and extend upwardly from upper sections of the shoe plates;

a tip seal that is connected to upper parts of the adapter plates and is adapted to seal against the tank shell;

a fabric barrier that is connected to the tip seal and is adapted for being disposed above the primary seal and connected to the floating roof;

coil springs adapted for pressing against the adapter plates and one or more brackets fixed to the floating roof to exert sufficient force along the axes of the springs to the adapter plates to apply a force to the upper sections of the shoe plates and to maintain the tip seal in sealing engagement against the tank shell; and an electrical insulator at one end of one of the springs, beneath the fabric barrier.

2. A secondary seal as recited in claim 1, and further comprising:

an electrical shunt above the fabric barrier.

3. A secondary seal as recited in claim 1, in which the tip seal is adapted to be mounted no more than about twelve inches above a top deck of the floating roof.

4. A secondary seal as recited in claim 1, in which the adapter plates are adapted to be installed in a sequential configuration.

5. A secondary seal as recited in claim 1, and further comprising an electrical shunt that is attached to the tip seal and adapted to be attached to the floating roof and disposed to remain in contact with the tank shell.

6. A secondary seal as recited in claim 1, in which a weather barrier is disposed above the fabric barrier.

7. A liquid storage tank that has:

a tank shell;

a floating roof within the tank shell;

a primary seal that is connected to the floating roof and has a set of shoe plates that bear against the tank shell;

adapter plates that mount to and extend upwardly from upper sections of the shoe plates;

a tip seal that is connected to upper parts of the adapter plates and seals against the tank shell;

a fabric barrier that is positioned above the primary seal and joins the tip seal to the floating roof;

springs that are attached to parts of the floating roof and exert sufficient force against the adapter plates to maintain the tip seal in sealing engagement against the tank shell; and an electrical insulator between the primary seal and the floating roof, beneath the fabric barrier.

8. A liquid storage tank as recited in claim 7, in which the tip seal is seated against the tank shell by the direct force of the springs against the adapter plates.

9. A liquid storage tank as recited in claim 7, and further comprising:

an electrical shunt above the fabric barrier.

10. A method for installing a secondary seal in a liquid storage tank that has a tank shell, a floating roof, and a primary seal that is connected to the floating roof and has a shoe plate adjacent the tank shell, the method comprising:

mounting adapter plates to upper sections of the shoe plates;

supporting a tip seal on upper parts of the adapter plates;

installing a fabric barrier between the floating roof and the tip seal, above the primary seal;

mounting springs that press against the floating roof and the adapter plates with sufficient force to maintain the tip seal in sealing engagement against the tank shell; and installing an electrical insulator between the primary seal and the floating roof, beneath the fabric barrier.

11. A method as recited in claim 10, and further comprising:

installing an electrical shunt between the secondary seal and the tank shell, above the fabric barrier.

* * * * *